United States Patent [19]

Misono et al.

[11] Patent Number: 4,794,301

[45] Date of Patent: Dec. 27, 1988

[54] FLUORESCENT LAMP HAVING A CONVOLUTED DISCHARGE PASSAGE AND FLUORESCENT LAMP APPARATUS INCORPORATING THE SAME

[75] Inventors: Katsuhide Misono, Yokohama; Yuji Kawaguchi; Kazuhisa Ogishi, both of Yokosuka; Shinichi Tsunekawa, Fujisawa; Taketo Kamei, Yokosuka, all of Japan

[73] Assignee: Kabushiki Kaisha Toshiba, Kawasaki, Japan

[21] Appl. No.: 86,519

[22] Filed: Aug. 18, 1987

[30] Foreign Application Priority Data

Aug. 19, 1986 [JP] Japan ..... 61-193501
Oct. 30, 1986 [JP] Japan ..... 61-259082

[51] Int. Cl.[4] ..... H01J 61/30; H01J 61/24

[52] U.S. Cl. ..... 313/490; 313/493

[58] Field of Search ..... 313/490, 493; 315/57, 315/58

[56] References Cited

U.S. PATENT DOCUMENTS 4,389,595 6/1983 Kamei et al. ..... 315/57
4,503,360 3/1985 Bedel ..... 313/493 X
4,694,215 9/1987 Hofmann ..... 313/493 X
4,695,767 9/1987 Wittmann ..... 313/493 X

FOREIGN PATENT DOCUMENTS 0062713 10/1982 European Pat. Off. ..... 313/493
0143419 6/1985 European Pat. Off. ..... 313/493
0152264 8/1985 European Pat. Off. ..... 313/490
5664662 10/1979 Japan .
58-159106 10/1983 Japan .
59-28956 2/1984 Japan .
0039732 3/1985 Japan ..... 315/58
60-207241 10/1985 Japan .
0078043 4/1986 Japan ..... 313/493
0156630 7/1986 Japan ..... 313/490

*Primary Examiner*—Palmer C. DeMeo
*Attorney, Agent, or Firm*—Cushman, Darby & Cushman

[57] ABSTRACT

A fluorescent lamp apparatus according to the present invention comprises a base member, a fluorescent lamp, and lighting means. The base member is a hollow member having a threaded base which can be screwed into the same type of socket as is used in ordinary incandescent lamps. It has a partition wall, and is divided thereby into a circuit chamber and an air chamber. The circuit chamber is located close to the base, and the air chamber communicates with the atmosphere. The lamp is attached to the base member, and comprises a tubular envelope, a pair of electrodes, and a mercury-vapor pressure adjusting means. The envelope is bent in shape, thus forming a discharge passage of a predetermined configuration, is sealed in an airtight fashion, and has both ends located close to the base member. The electrodes are contained within the end portions of the envelope. The mercury-vapor pressure control means incorporates a quantity of amalgam which is held within the air chamber of the base member, and is designed to supply mercury vapor into the envelope. The lighting means is located with the circuit chamber of the base member and is electrically connected to the electrodes of the fluorescent lamp, for lighting the lamp.

17 Claims, 7 Drawing Sheets

FLUORESCENT LAMP HAVING A CONVOLUTED DISCHARGE PASSAGE AND FLUORESCENT LAMP APPARATUS INCORPORATING THE SAME

BACKGROUND OF THE INVENTION

1. Field of the Invention

The present invention relates to a fluorescent lamp apparatus for providing light and, more particularly, to a fluorescent lamp having a convoluted envelope, and a lamp apparatus which incorporates this fluorescent lamp and can be used, for example, as a direct replacement of incandescent lamps.

2. Problems of the Prior Art

The conventional fluorescent lamp apparatus of the type described above comprises a fluorescent lamp having a convoluted envelope forming a discharge passage, a base member having a base of the same type as that of the ordinary incandescent lamp and supporting the fluorescent lamp, a globe attached to the base member and enclosing the fluorescent lamp, and a lighting circuit provided within the base member. The lighting circuit necessarily has ballast, e.g., a choke coil, for limiting the amount of current flowing through the circuit. The choke coil generates heat for as long as the fluorescent lamp is turned on, as do the lamp electrodes. Since the lamp is attached to the base structure containing the choke coil and has a convoluted envelope, it is heated to a higher temperature than a straight tubular type lamp.

Generally, the luminosity of a fluorescent lamp depends upon the ambient temperature. When the temperature of the mercury vapor source of the fluorescent lamp rises above the upper limit of the optimum temperature range, the luminosity of the lamp drops. A fluorescett lamp apparatus of the type which is free of this problem is disclosed in Japanese Utility Model Application Disclosure No. 59-28956. This apparatus comprises a base containing a lighting circuit, and a globe section including a convoluted fluorescent lamp. The base section and the globe section are detachably connected, and an air gap is provided between them. This air gap is open to the atmosphere, and cool air is always in this gap. The air gap, therefore, reduces the transfer of the heat generated from the lighting circuit to the fluorescent lamp in the globe section. The mercury vapor source of the lamp is not heated above the upper limit of the optimum temperature range, and the a drop of the luminosity of the lamp is prevented.

Japanese Patent Disclosure No. 60-207241 discloses a fluorescent lamp apparatus wherein a quantity of amalgam is contained within a convoluted envelope. More specifically, the amalgam mass is provided in an exhaust tube protruding from that portion of the envelope in which stems having electrodes are located. The use of the amalgam mass as a mercury vapor source, raises the upper limit of the optimum temperature range, whereby a drop of the luminosity, which may result from a temperature rise of the envelope, can be more readily prevented.

Attempts have been made to develop fluorescent lamp apparatuses which are smaller and provide a greater output than those described above. The lamp of each of these apparatuses generate much heat. Even if an air gap is provided in the lamp apparatus, thus reducing the transfer of heat from the lighting circuit to the lamp, the mercury vapor source of this lamp is heated to a temperature above the upper limit of the optimum range. A mass of amalgam may be contained in the lamp in order to raise the upper limit of the optimum temperature range. Even so, the luminosity of the lamp apparatus may drop.

SUMMARY OF THE INVENTION

It is accordingly the object of the present invention to provide a fluorescent lamp apparatus wherein the temperature of a mercury vapor source provided within a fluorescent lamp can be controlled to fall within the optimal temperature, thereby to prevent a drop of the luminosity of the fluorescent lamp.

A fluorescent lamp apparatus according to the invention comprises a base member, a fluorescent lamp, and lighting means. The base member is a hollow member having a threaded base which can be screwed into the same type of socket as is used in ordinary incandescent lamps. The base member has a partition, and is divided thereby into a circuit chamber and an air chamber. The circuit chamber for receiving the lighting means is situated close to the base, and the air chamber communicates with the atmosphere. The fluorescent lamp is attached to the base member. The lamp comprises a tubular envelope which is bent in shape and thus forms a discharge passage having a predetermined configuration, a pair of electrodes, and a quantity of amalgam arranged in a tube connected to the tubular envelope the amalgam being located in the air chamber. The tubular envelope is sealed in an airtight fashion and has both ends located close to the base member. The electrodes are arranged within the end portions of the envelope. The lighting means is located within the circuit chamber of the base member, and is electrically connected to the electrodes for lighting the fluorescent lamp.

BRIEF DESCRIPTION OF THE DRAWINGS

The features of the invention may be clearly understood from the following detailed description, when taken in conjunttion with the accompanying drawings, in which.

DETAILED DESCRIPTION OF THE PREFERRED EMBODIMENTS

Embodiments of the present invention will now be described with reference to the accompanying drawings.

Figure 1:
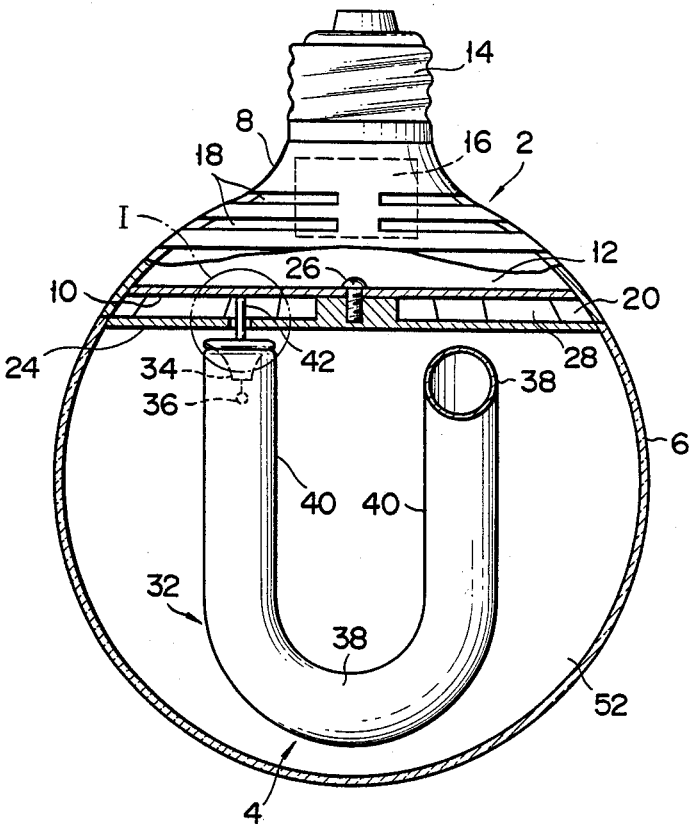
FIG. 1 is a partially sectional, front view of a fluorescent lamp apparatus according to a first embodiment of the present invention.
Figure 2:
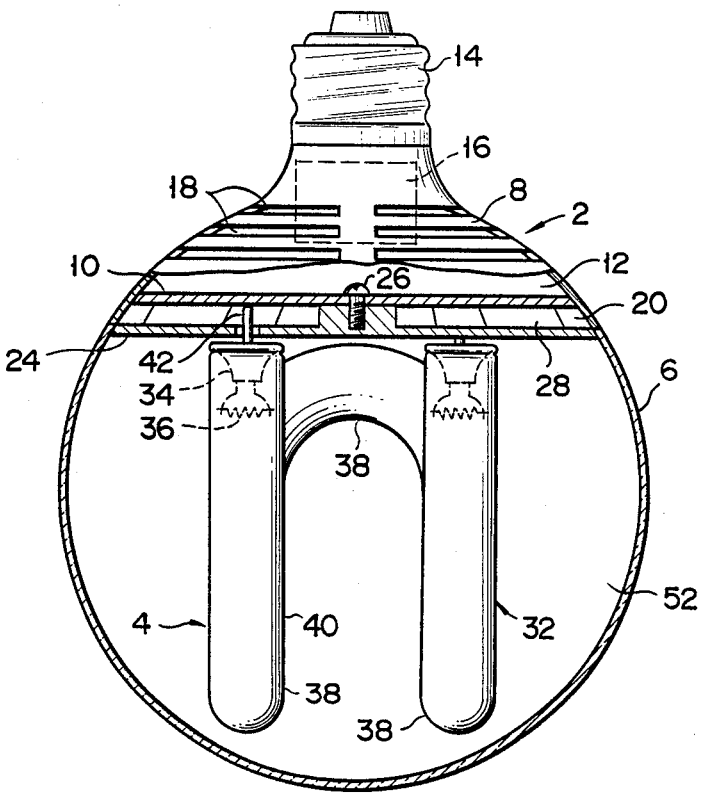
FIG. 2 is a partially sectional, side view of the lamp apparatus shown in FIG. 1.
Figure 3:
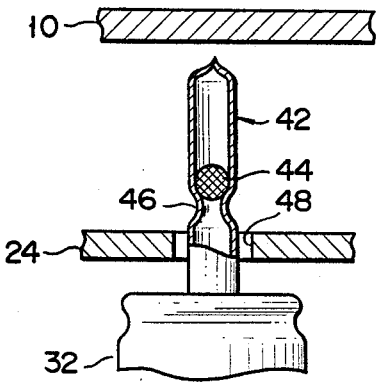
FIG. 3 is an enlarged view of portion I of the lamp apparatus, indicated by the one-dot, one-dash circle in FIG. 1.

FIGS. 1 to 3 show a fluorescent lamp apparatus according to a first embodiment of the present invention. As is shown in FIG. 1, the lamp apparatus comprises a base section and a globe section. The base section includes base member 2, in which a lighting circuit means is provided. The globe section includes fluorescent lamp 4, and globe 6 protectively closing lamp 4. As a whole, the apparatus is ball-shaped.

Base member 2 is composed of housing 8 partition 10, and cover 24. Housing 8 formed in the shape of a cup is provided with a base which can be screwed into the sockets of the fixtures designed for ordinary incandescent lamps. Cover 24 closes an opening of housing 8 to form a chamber. Partition 10, which is a thin disc, is provided for dividing the chamber into circuit chamber 12 and air chamber 20. Ballast 16 (e.g., a choke coil) and some other components of the lighting circuit means are arranged within circuit chamber 12.

Cover 24 consists of a disc and a projection which protrudes 3 mm to 10 mm from the disc. After securing partition 10 to cover 24 by screw 26, cover 24 is fitted to housing 8. Cover 24 extends parallel to partition 10, and a gap of 3 mm to 10 mm, i.e., air chamber 20, is provided between partition 10 and cover 24. Housing 8 has slits 18 for radiating the heat generated by ballast 16, thereby cooling circuit chamber 12. The lower end portion of the side wall of housing 8 has slits 28 through which air can flow into and out of air chamber 20.

Fluorescent lamp 4 is provided within globe 6 and attached to the cover 24. Lamp 4 comprises triple-U-bent tubular envelope 32, two stems 34, a pair of electrodes 36, and lead-in wires (not shown). Triple-U-bent envelope 32 has been made by bending a straight tube into a U-shaped tube, and then bending the straight, parallel portions of the U-shaped tube, such that three U-shaped portions 38 and four straight portions 40 are formed. It is desired that four straight portions 40 be parallel to one another. A phosphor layer is formed on the inner surface of envelope 32. Stems 34 seal the ends of envelope 32. Electrodes 36 are provided within envelope 32, supported by stems 34, and spaced apart from each other. Lead-in wires (not shown) are connected, at one end, to electrodes 36, and at the other end, to the components of the lighting circuit means provided within circuit chamber 12. A voltage is applied between electrodes 36, thus causing an electric discharge. The electric discharge excites the mercury vapor emanating from mass 44 of amalgam (later described), thereby generating ultraviolet rays. The ultraviolet rays impinge upon the phosphor layer of envelope 32, whereby the phosphor layer emits visible light. Triple-U-bent envelope 32 is fastened to cover 24. That is, its both ends and its middle U-shaped portion 38 are coupled to cover by supports (not shown).

As is shown in detail in FIG. 3, thin tube 42 is integrally formed with one end of envelope 32. This tube 42 is a portion of the exhaust tube formed when envelope 32 is evacuated, and is made by cutting the exhaust tube and closing its open end. Thin tube 42 contains mass 44 of amalgam, which functions as a mercury-vapor pressure adjusting means. Tube 42 has constriction 46 having an inner diameter which is small enough to prevent amalgam mass 44 from entering envelope 32. Hence, amalgam mass 44 remains within that portion of thin tube 42 which extends from the closed end to constriction 46.

As is shown also in FIG. 3, through hole 48 is cut in cover 24. Thin tube 42 projects into air chamber 20 through hole 48 of cover 24, such that its portion containing amalgam mass 44 is located within air chamber 20. Hence, amalgam mass 44, or the mercury vapor source, is provided within air chamber 20 which communicates with the atmosphere.

Fluorescent lamp 4 is enclosed in and thus protected by globe 6. Base member 2, except for base 14, and globe 6 form a ball. Globe 6 is secured to cover 24, thus forming chamber 52. Lamp 4 is provided within this chamber 52. Globe 6 is made of a synthetic resin, either transparent or semitransparent.

As has been described, fluorescent lamp 4, or more precisely, the lead-in wires, are electrically connected to the components of the lighting circuit means accommodated in circuit chamber 12. Lamp 4 can therefore be lighted by the lighting circuit means. While lamp 4 is on, the components of the lighting circuit means, in particular, ballast 16, generate heat, thus raising the temperature in circuit chamber 12. Simultaneously, fluorescent lamp 4 also generates heat, thereby raising the temperature in chamber 52. Nonetheless, the temperature of amalgam mass 44 does not rise since mass 44 is located in air chamber 20 which is provided between circuit chamber 12 and chamber 52 and is cooled by the air flowing in from the atmosphere. Amalgam mass 44, or the mercury vapor source, is not heated excessively. The luminosity of the fluorescent lamp apparatus can, therefore, be prevented from decreasing.

To demonstrate the advantages of the present invention over the prior art, the inventors thereof made fluorescent lamp apparatuses identical to the one shown in FIGS. 1 to 3, and conducted the following experiments on these apparatuses and also on the conventional lamp apparatus of the same type in which the thin tube containing a mass of amalgam is located within the globe. The prior art apparatus and the apparatuses of this invention were lighted for some time. The thin tube of the prior art apparatus was heated to 125° C., and the lamp current of the apparatus was 750 mA. In contrast, thin tube 42 of each apparatus according to the invention was heated to 100° C., and the lamp current of the apparatus was 680 mA. The input power of the conventional apparatus was 37 W, whereas the input power of the apparatus of the invention was 33 W. The temperature of the winding of ballast 16 was 20° C. lower than that in the prior art lamp apparatus, and the temperature of envelope 24 was 15° C. lower than that in the conventional lamp apparatus.

Figure 4:
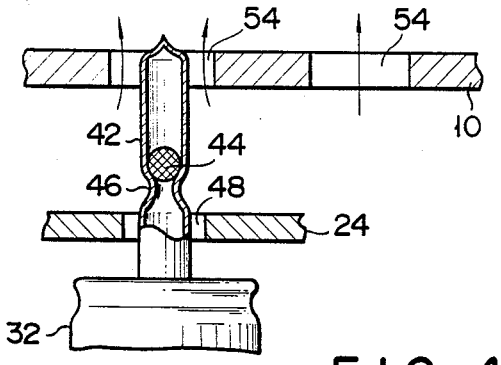
FIG. 4 is an enlarged view of that portion of another fluorescent lamp of the present invention, which is equivalent to portion I of the apparatus shown in FIG. 1.

FIG. 4 shows a portion of a fluorescent lamp apparatus according to a second embodiment of this invention. In this embodiment, the gap between partition 10 and cover 24 is relatively narrow. As is shown in FIG. 4, partition 10 has vent holes 54, through which air can flow between circuit chamber 12 and air chamber 20 to cool a lighting circuit means provided within circuit chamber 12. Thin tube 42 projecting from one end of fluorescent lamp 4 passes through hole 48 of cover 24 and also through one of vent holes 54 of partition 10, and projects into circuit chamber 12. In this embodiment, too, mass 44 of amalgam provided within thin tube 42 is located within air chamber 20. Air flows from air chamber 20 into circuit chamber 12, through holes 54, and from circuit chamber 12 to the atmosphere, through slits 18. As the air flows in this manner, it cools amalgam mass 44 contained in thin tube 42, whereby the mercury-vapor pressure is appropriately controlled.

Figure 5:
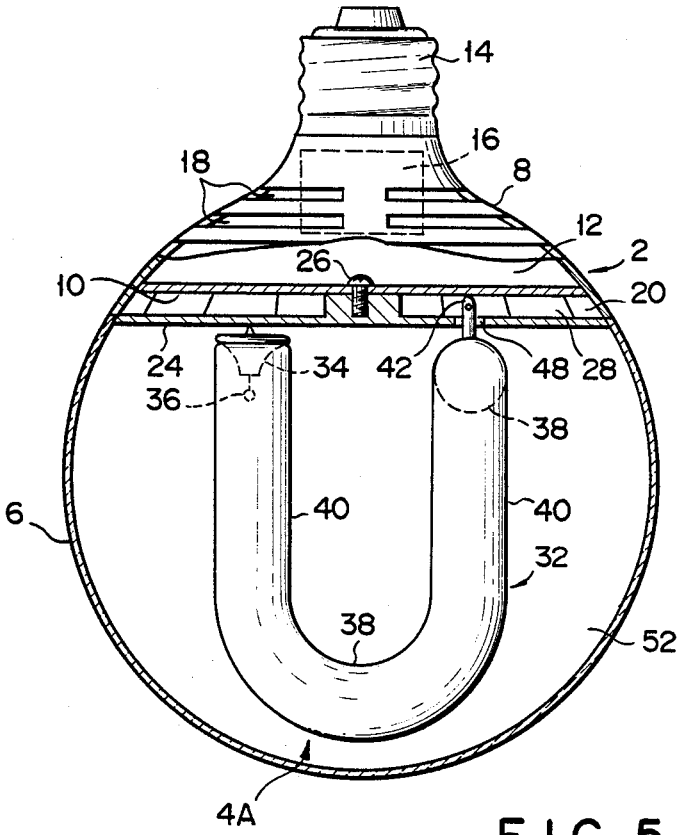
FIG. 5 is a partially sectional, front view of a fluorescent lamp apparatus according to a third embodiment of the present invention.

FIG. 5 illustrates a third embodiment of the present invention. As may be seen from this figure, in the third embodiment, thin tube 42 projects into air chamber 20 through a hole cut in cover 24, from that U-shaped portion 38 of triple-U-bent tubular envelope 32 which is located near air chamber 20, not from one end of tubular envelope 32, as in the first and second embodiments. Amalgam mass 44 is contained within thin tube 42 and located in air chamber 20, as in the first and second embodiments. Since thin tube 42 is located farther from electrodes 36 than in the first and second embodiments, amalgam mass 44 is less affected by the heat emanating from electrodes 36. Further, since tube 42 extends from envelope 32 in the radial direction thereof, and thus is remote from the discharge passage extending between electrodes 36, it is virtually unaffected by the heat generated by the electric discharge occurring in the discharge passage. Therefore, amalgam mass 44 contained in thin tube 42 will normally never be heated to too high a temperature.

Figure 6:
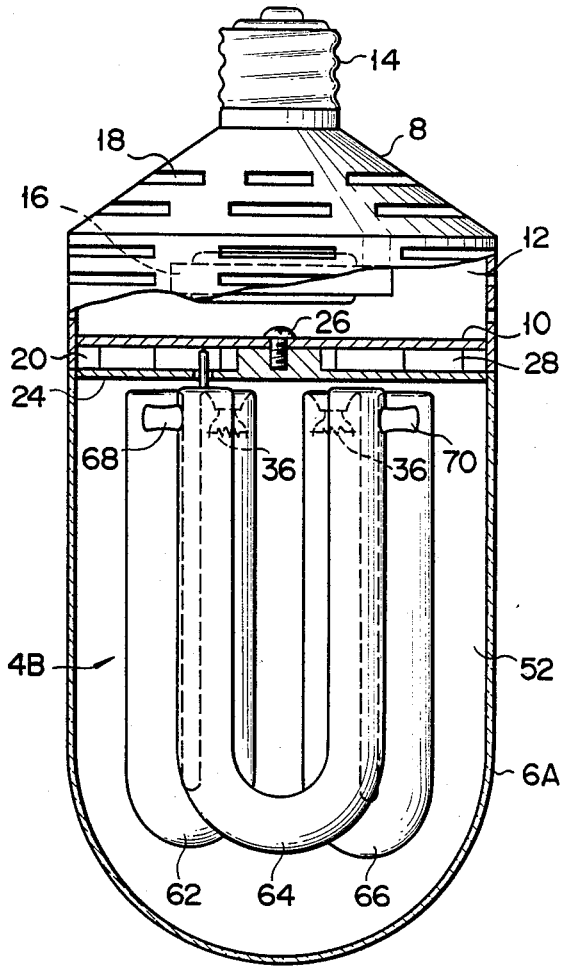
FIG. 6 is a partially sectional, front view of a fluorescent lamp apparatus according to a fourth embodiment of the present invention.

FIG. 6 shows still another fluorescent lamp apparatus, according to a fourth embodiment of the invention. This apparatus features fluorescent lamp 4B consisting of three U-shaped tubular envelopes, not a triple-U-bent tubular envelope as is used in the first, second, and third embodiments. In the fourth embodiment, base structure 2 comprises a truncated conical hollow portion having base 14 connected to its upper end, and a cylindrical portion coupled to its lower end. Globe 6A is connected to the lower end of base member 2, thus enclosing and protecting fluorescent lamp 4B. Globe 6A is substantially cylindrical in shape and has a rounded lower end. It has the same diameter as the cylindrical portion of base member 2. Fluorescent lamp 4B is constructed as follows:

First, three straight tube are bent at their middle portions, thereby forming three U-shaped tubes, 62, 64, and 66, each having two straight and parallel portions connected by a U-shaped portion. U-shaped tubes 62, 64, and 66 are then arranged such that their ends are located in the same plane, their straight portions extend parallel to one another, and their U-shaped portions are positioned close to one another. Arranged thus, one end of U-shaped tube 64 is coupled with one end of U-shaped tube 62 through connection tube 68, and the other end of U-shaped tube 64 is coupled with one end of U-shaped tube 66 through connection tube 70. Two stems 34 are provided within the ends of U-shaped tubes 62 and 66, which are not coupled with U-shaped tube 64. Two electrodes 36 are supported by these stems 34. The other ends of U-shaped tubes 62 and 66, and both ends of U-shaped tube 64, are closed by dummy stems. Two lead-in wires (not shown) are connected, at one end, to the electrodes 36. Thin tube 42 containing mass 44 of amalgam is coupled with the end of one of U-shaped tubes 62, 64, and 66, preferably with the end containing no electrodes. Fluorescent lamp 4B, thus formed, is attached to base member 2, so that amalgam mass 44 is located within air chamber 20, as in the first, eecond, and third embodiment.

In the fourth embodiment, a discharge passage extends between electrodes 36. This discharge passage comprises first U-shaped tube 62, connection tube 68 connecting first and second U-shaped tubes 62 and 64, second U-shaped tube 64, connection tube 70 coupling second and third U-shaped tubes 64 and 66, and third U-shaped tube 66. Since amalgam mass 44 contained in thin tube 42 is located within air chamber 20, also in the fourth embodiment, it is unlikely that it will ever be heated too high in temperature. As a result, the flurrescent lamp apparatus of this embodiment can be prevented from dropping of luminosity.

Figure 7:
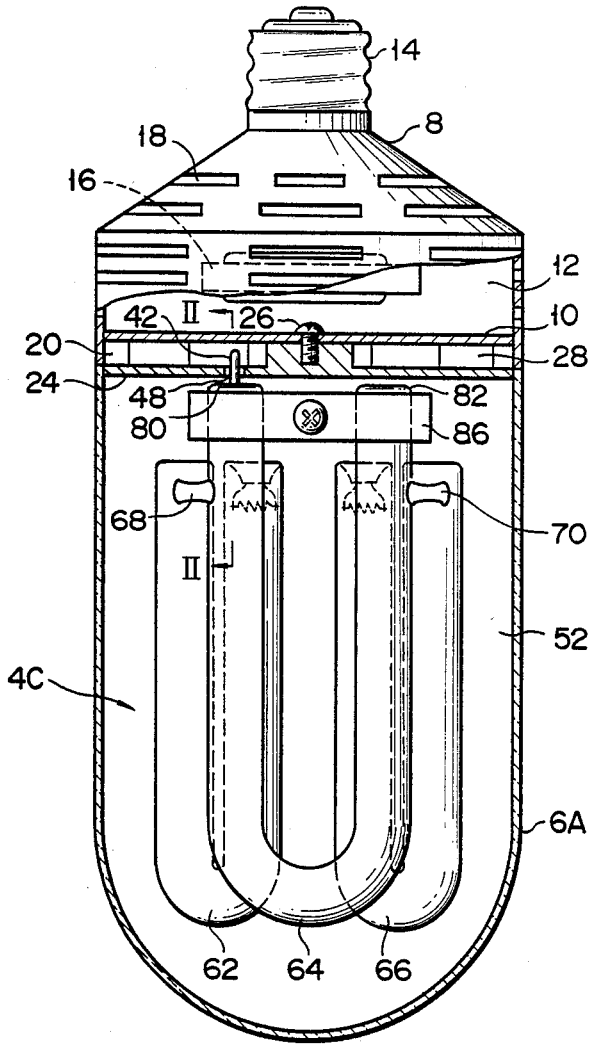
FIG. 7 is a partially sectional, front view of a fluorescent lamp apparatus according to a fifth embodiment of the present invention.
Figure 8:
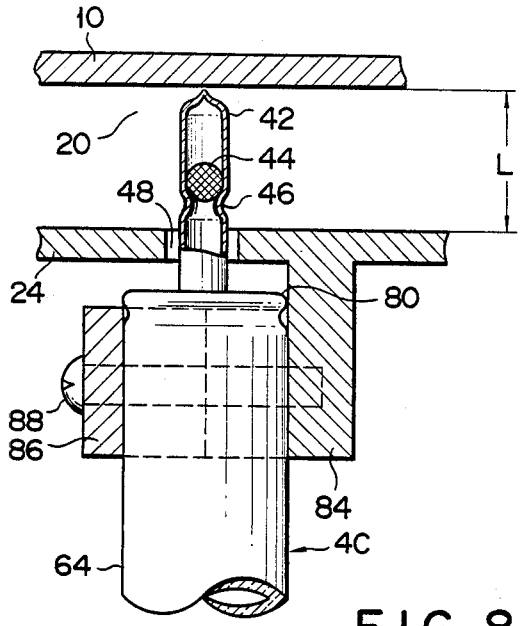
FIG. 8 is a partially sectional view of a portion of the fluorescent lamp apparatus of FIG. 7, taken along line II—II in FIG. 7.
Figure 9:
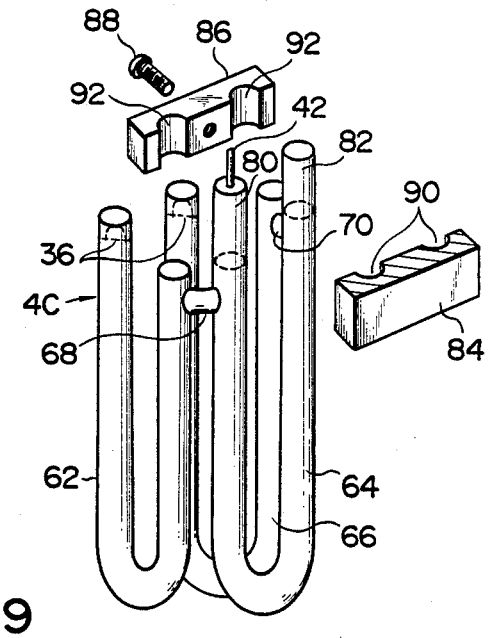
FIG. 9 is an exploded view of the fluorescent lamp apparatus of FIG. 7, explaining how the fluorescent lamp of the apparatus is supported.

FIG. 7 shows a fluorescent lamp apparatus according to a fifth embodiment of the present invention. As is shown in this figure, this apparatus is similar to the fourth embodiment (FIG. 6), but is different in that one of three U-shaped tubes 62, 64, and 66, i.e., U-shaped tube 64 which contains no electrodes, has two straight portions longer than those of two other U-shaped tubes 62 and 66. Namely, two extensions 80 and 82 are connected to the ends of U-shaped tube 64, respectively. Thin tube 42, which contains amalgam mass 44 as in the fourth embodiment is projecting from extension 80. As is shown in FIGS. 8 and 9, fluorescent lamp 4C is supported by a pair of supports 84 and 86. Support 84 is integrally formed with cover 24, and has two U grooves 90. Support 86 has substantially the same shape and size, and also has two U grooves 92. Supports 84 and 86 are fastened together by means of screw 88, thus clamping extensions 80 and 82 of U-shaped tube 64 and holding them in the holes defined by U grooves 90 and 92. As a result, fluorescent lamp 4C is held and supported securely. Thin tube 42 extends into air chamber through hole 48 cut in cover 24. The heat emanating from electrodes 36 is not directly transmitted to extensions 80 and 82 or thin tube 42. In addition, thin tube 42 is located farther from the discharge passage of lamp 4C than any other part of lamp 4C, and is thus maintained at the lowest temperature in fluorescent lamp 4C. In the fifth embodiment, mercury can be used in place of amalgam mass 44 to adjust the mercury-vapor pressure within fluorescent lamp 4C, since the rise in temperature of thin tube 42 is extremely small.

Figure 10:
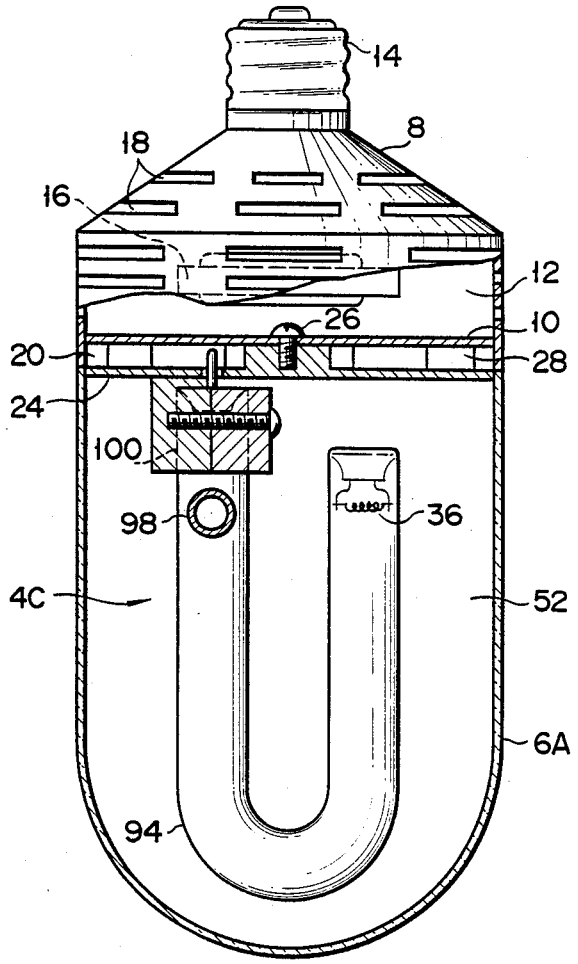
FIG. 10 is a partially sectional, front view of a fluorescent lamp apparatus according to a sixth embodiment of the present invention.

Fluorescent lamp 4C of the fifth embodiment comprises three U-shaped tubes. Alternatively, the lamp can be made of two U-shaped tubes, as is illustrated in FIG. 10. More specifically, fluorescent lamp of the lamp apparatus of FIG. 10, which is a six embodiment of the invention, has fluorescent lamp 4D comprises two U-shaped tubes 94 and 96, each consisting of two straight, parallel portions and a U-shaped portion. Tubes 94 and 96 are positioned such that their U-shaped portions are close to each other. Those ends of the U-shaped portions which are located near each other are coupled by connection tube 98. Extensions 100 and 102 are connected to these ends of the U-shaped tubes 94 and 96. Electrodes 36 are located within the other ends of U-shaped tubes 94 and 96. Extensions 100 and 102 are held by supports of the same type used in the fifth embodiment (FIGS. 8 and 9), thereby supporting fluorescent lamp 4D. As in the fifth embodiment (FIGS. 8 and 9), thin tube 42 projects from extension 100. This embodiment can attain the same advantages as the fifth embodiment. In addition, mercury can be used in place of amalgam mass 44 to adjust the mercury-vapor pressure within fluorescent lamp 4C, since the rise in temperature of thin tube 42 is extremely small.

What is claimed is:

1. A fluoresecent lamp apparatus comprising:

a fluorescent lamp including a tubular envelope having two end portions, a pair of electrodes and a quantity of amalgam being disposed at one end portion and forming a discharge passage between said electrodes, the amalgam being located in a tube communicating with said envelope, a lighting means electrically connected to said electrodes for lighting said fluorescent lamp, a base member supporting said flouorescent lamp including:

a housing wherein said lighting means is disposed;

a partition wall partitioning said housing to form a chamber within said housing wherein said lighting means is installed; and a cover member spaced from said partition wall by a predetermined distance and defining an air chamber between itself and said partition wall, said air chamber being located between said lighting means and said fluorescent lamp and communicating with the atmosphere so that air streams are suppressed, the tube containing the amalgam being disposed in said air chamber.

2. The fluorescent lamp apparatus according to claim 1, wherein one end portion of said tube commuicates with said tubular evelope and the other end portion thereof is closed.

3. The fluorescent lamp apparatus according to claim 2, wherein said one end of said tube is connected to one end portion of said tubular envelope.

4. The fluoresecent lamp apparatus according to claim 2, wherein said one end of said tube is connected to that portion of said tubular envelope other than the portion containing said electrodes, which is located close to said air chamber.

5. The fluroescent lamp apparatus according to claims 2, wherein said tube extends through said cover member and partition wall.

6. The fluorescent lamp apparatus according to claim 1, wherein said tubular envelope comprises a plurality of U-shaped envelopes each consisting of two straight, parallel portions and a U-shaped portion connecting the straight, parallel portions, said U-shaped envelopes being arranged such that their U-shaped portions are close to each other, and being connected, at one end, to each other, thus forming said single discharge passage.

7. The fluorescent lamp apparatus according to claim 6, wherein said mercury-vapor pressure control means includes a tube, one end of which communicates with said tubular envelope, the other end thereof being closed.

8. The fluorescent lamp apparatus according to claim 7, wherein said one end of said tube is connected to none end portion of said tubular envelope.

9. The fluorescent lamp apparatus according to calim 7, wherein said one end of said tube is connected to that portion of said tubular envelope other than the portion containing said electrodes, which is located close to said air chamber.

10. The florescent lamp apparatus according to claim 7, wherein said tube extends through said cover member and partition wall.

11. The fluorescent lamp apparatus according to claim 6, wherein said tubular envelope has at least one extension continuous to the straight portions of said U-shaped envelopes, other than those straight portions containing said electrodes.

12. The fluorescent lamp apparatus according to claim 11, wherein one end of said tube is connected to said one extension of said tubular envelope and the other end thereof is closed.

13. The fluorescent lamp apparatus according to claim 12, wherein said tube extends through said cover member and partition wall.

14. The fluorescent lamp according to claim 1, said partition wall and said cover member being arranged in parallel relation to each and being spaced 3 through 10 mm from each other.

15. A fluoresecent lamp comprising:

a tubular envelope sealed in an airtight fashion, which includes a plurality of U-shaped envelopes each consisting of two straight, parallel portions and a U-shaped portion connecting the straight, parallel portions, said U-shaped envelopes being arranged such that their U-shaped portions are close to each other, and being connected, at one end, to each other, thus forming a single discharge path, a phosphor layer formed on the inner surface of said tubular envelope, a pair of electrodes contained within the end portions of said tubular envelope, and a quantity of amalgam located in a tube communicating with said tubular envelope, said amalogam being disposed so that the temperature of said amalgam is maintained between 80° C. and 100° C.

16. The fluorescent lamp according to claim 15, wherein said tubular envelope has at least one extension continuous to the straight portions of said U-shaped envelopes, other than those straight portions containing said electrodes, one end of said tube is connected to said one extension of said tubular envelope and the other end thereof is closed.

17. The fluorescent lamp according to claim 16, wherein said mercury-vapor pressure control means includes a tube, one end of which is connected to said extension, the other end thereof being closed, and a quantity of amalgam which is contained within said tube.

* * * * *